United States Patent [19]

Durham, Jr.

[11] 4,227,345

[45] Oct. 14, 1980

[54] TILT-LOCK SLIDE FOR WINDOW SASH

[76] Inventor: Robert C. Durham, Jr., 2416 NE. 27 Terrace, Fort Lauderdale, Fla. 33305

[21] Appl. No.: 6,653

[22] Filed: Jan. 26, 1979

[51] Int. Cl.[2] ..... E05D 13/12

[52] U.S. Cl. ..... 49/181; 49/445; 49/453

[58] Field of Search ..... 49/181, 445, 453

[56] References Cited

U.S. PATENT DOCUMENTS

| | | | |
|---|---|---|---|
| 1,226,145 | 5/1917 | Taylor | 49/181 X |
| 1,925,059 | 8/1933 | Sheard et al. | 49/445 |
| 2,067,164 | 1/1937 | Smith | 49/445 X |
| 3,118,190 | 1/1964 | Love | 49/181 X |
| 3,348,335 | 10/1967 | Mauro | 49/181 |
| 3,789,549 | 2/1974 | Yip | 49/181 |

*Primary Examiner*—Kenneth Downey

*Attorney, Agent, or Firm*—Oltman and Flynn

[57] ABSTRACT

One-piece member with a cam-shaped periphery serves as both a slide and a tilt-lock for a window sash which is slidable vertically in a window frame and is tiltable with respect to the window frame. A thin, flat, elongated spring leaf has its lower end attached to the combined slide and tilt-lock member and has a spirally wound upper end fastened to the window frame. The window frame conceals and protects the unwound length of this spring.

2 Claims, 10 Drawing Figures

TILT-LOCK SLIDE FOR WINDOW SASH

SUMMARY OF THE INVENTION

This invention relates to a combined slide and tilt-lock and a counterbalance spring for a vertically slidable and tiltable window sash.

U.S. Pat. No. 3,789,549 to Yip discloses a slide for a window sash which is received in a vertically elongated track in an adjacent side of the window frame. A helical spring extending vertically along the track acts between the window frame and the slide to counterbalance the weight of the window sash and window pane. A locking member with a cam-shaped periphery is rotatably mounted on the slide for adjustment between a position in which it does not impede the up or down sliding movement of the window sash and a locking position wedged in the track, which it occupies when the sash is tilted into the room. In its locking position, the locking member prevents up or down displacement of the window sash in the window frame.

The present invention is directed to a novel and improved simplified arrangement for the same general purpose. In accordance with the present invention, a one-piece member acts as both a slide for guiding the up and down movement of the window sash and as a tilt-lock for preventing such movement when the sash is tilted with respect to the window frame. The counterbalance spring for the window sash is a thin, flat, elongated spring leaf which is wound into a spiral at its upper end and is anchored there to the window frame. The lower end of this spring is attached to the combined slide and tilt-lock for the window sash. Between its sprially-wound upper end and its lower end, the unwound thin, flat length of the spring extends closely down along one wall of the slide track in the window frame and is concealed and protected by the frame.

If desired, one or more additional springs of the same type may be mounted in the window frame directly above the first spring, and the unwound length of each additional spring or springs may extend down next to the unwound length of the first spring in the slide track for attachment to the combined slide and tilt-lock. The springs do not interfere with each other or with the up and down movement of the window sash, and the provision of more than one such spring at each side of the window sash enables a heavier sash to be counterbalanced properly.

A principal object of this invention is to provide a novel and improved vertical slide and tilt-lock and counterbalance spring arrangement for a window sash.

Another object of this invention is to provide such an arrangement in which a single slide member with a cam-shaped periphery acts as both a vertical slide and a tilt-lock for the window sash.

Another object of this invention is to provide such an arrangement having a counterbalance spring in the form of a thin, flat, elongated spring leaf with a spirally-wound upper end fastened to the window frame and with its unwound thin, flat length below its upper and concealed and protected by the window frame, and its lower end fastened to the combined slide and tilt-lock member.

Further objects and advantages of the present invention will be apparent from the following detailed description of the two presently-preferred embodiments shown in the accompanying drawings.

Before explaining the disclosed embodiments of the present invention in detail, it is to be understood that the invention is not limited in its application to the details of the particular arrangements shown since the invention is capable of other embodiments. Also, the terminology used herein is for the purpose of description and not of limitation.

DETAILED DESCRIPTION

Figure 1:
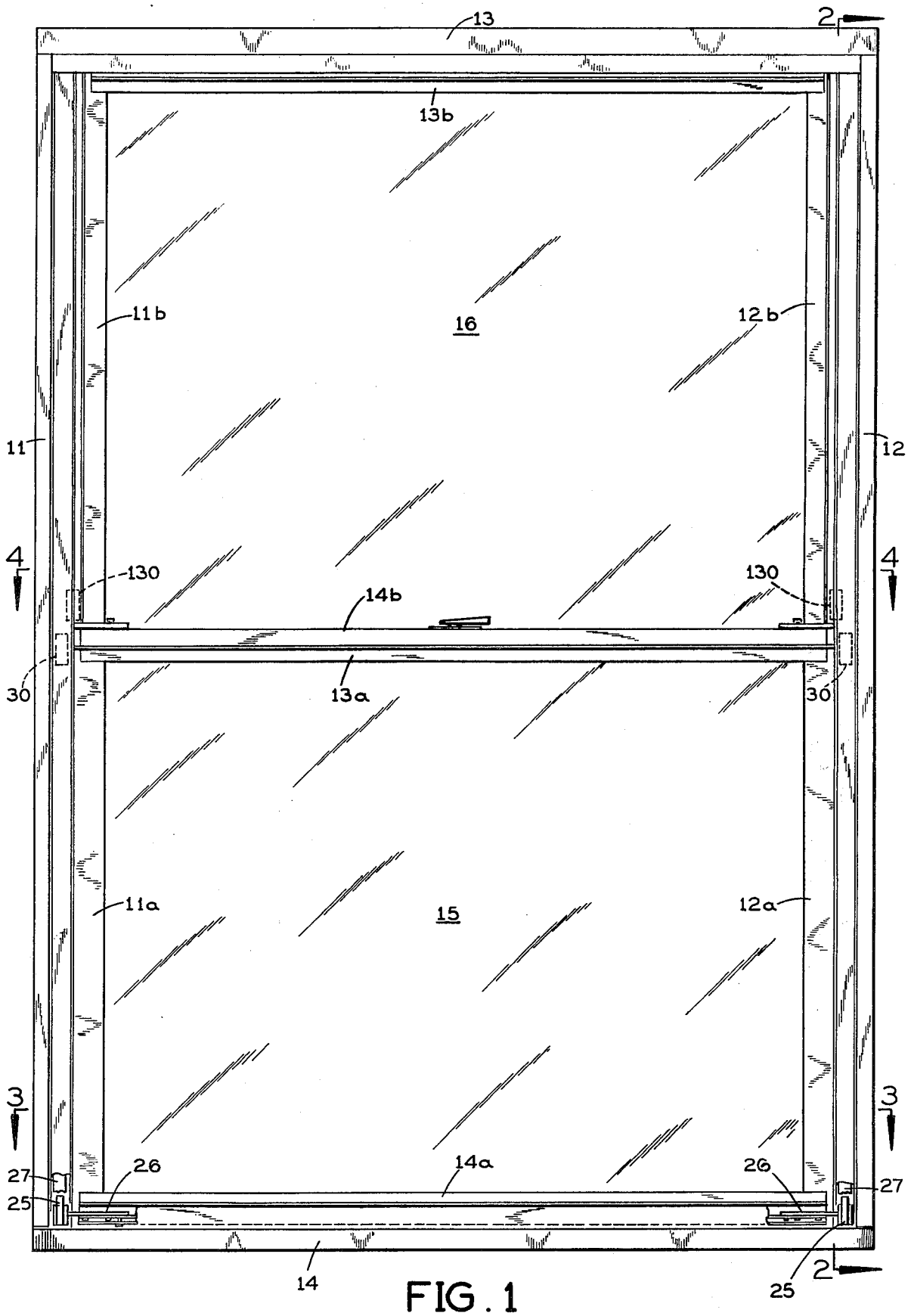
FIG. 1 is an elevational view of a closed window having a frame and upper and lower sashes equipped with springs and tilt-lock slides in accordance with a first embodiment of this invention.

Referring to FIG. 1, a rectangular window frame is shown having opposite vertical sides 11 and 12, a top piece 13 extending horizontally between the opposite sides 11 and 12 at their upper ends, and a bottom piece 14 extending horizontally between these sides at their lower ends. The top and bottom pieces are rigidly connected at their opposite ends to the respective sides to provide a unitary, rigid window frame which may be mounted in an outside wall of a building in a known manner.

The window has a rigid rectangular lower sash with opposite vertical sides **11*a* and 12*a* joined to a horizontal top piece 13*a* and a horizontal bottom piece 14*a*. This sash extends peripherally around and supports a lower window pane 15. The lower sash fits entirely inside the window frame, with the opposite sides 11*a* and 12*a* of this sash in close proximity to and inside the corresponding sides 11 and 12** of the window frame toward the inner (room) side of the frame.

The window also has a rigid upper sash with opposite vertical sides **11*b* and 12*b*, a horizontal top piece 13*b*, and a horizontal bottom piece 14*b*, which extends around and supports an upper window pane 16. The upper sash fits entirely inside the window frame, with the opposite sides 11*b* and 12*b* of this sash in close proximity to and inside the corresponding sides 11 and 12** of the window frame toward the outer (building exterior) side of the frame.

Figure 8:
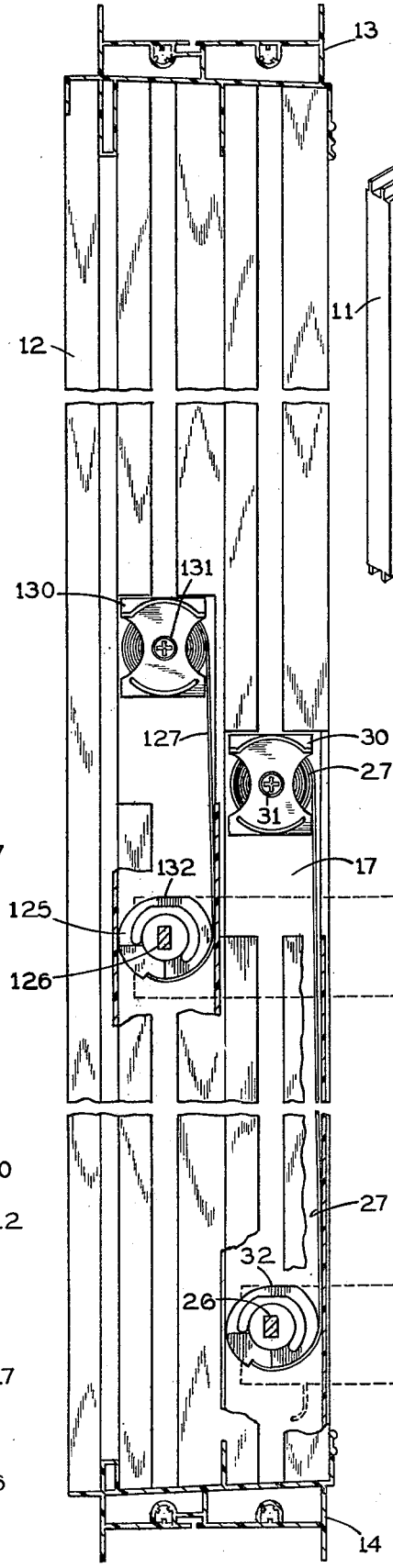
FIG. 8 is a perspective view of the FIG. 1 window with the window sashes tilted into the room.
Figure 8:
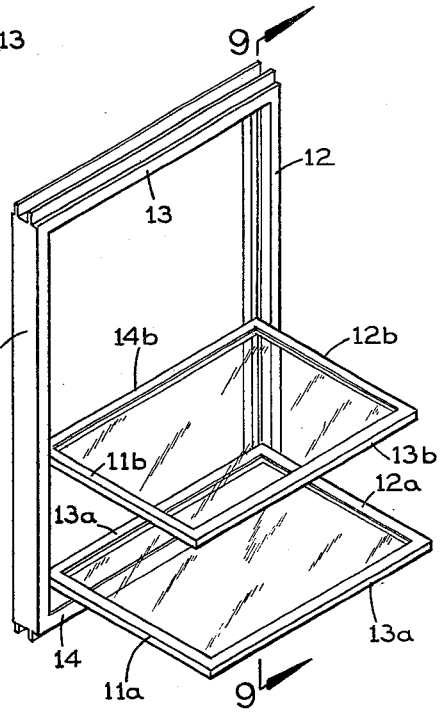

Both window sashes are slidable vertically in the window frame. Both sashes may be tilted from an upright vertical position (FIGS. 1 and 2), in which they fit snugly inside the window frame, to a tilted position (FIGS. 8 and 9), in which they extend down horizontally away from the window frame into the room for cleaning of the outside of the respective window panes.

Figure 4:
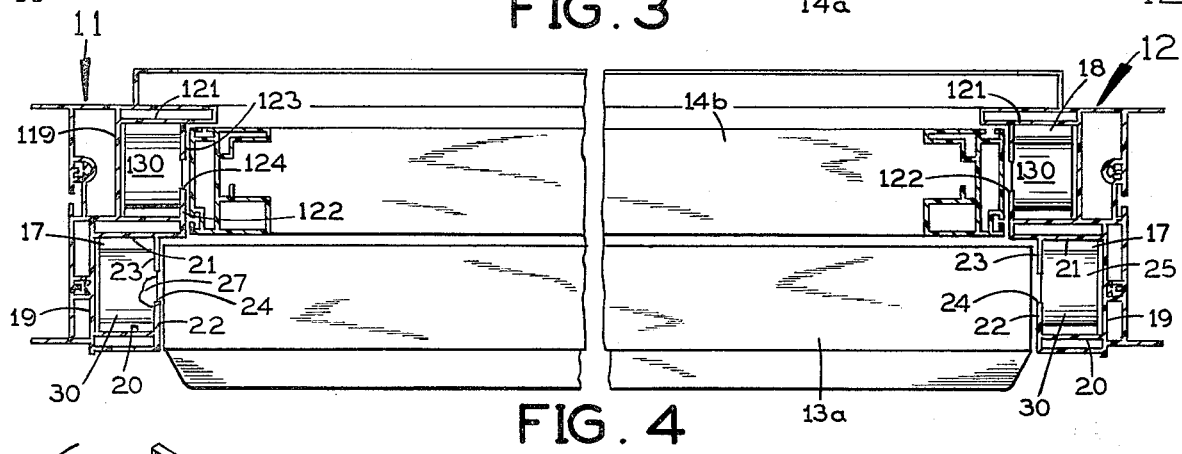
FIG. 4 is a horizontal cross-section taken along the line 4—4 in FIG. 1.

Referring to FIG. 4, the right side 12 of the window frame presents a vertically elongated inner track 17, which is aligned with the lower window sash 11*a*–14*a*, and a vertically elongated outer track 18, which is aligned with the upper window sash 11*b*–14*b*. The inner track 17 is located closer to the inside of the building than the outer track 18.

The inner track 17 is of rectangular cross-section throughout its vertically elongated length. It is defined by an outer end wall 19, which is at the laterally outward side of the track, away from the window sash, a pair of side walls 20 and 21 joined to the outer end wall 19 and extending perpendicular to it laterally inward toward the adjacent side 12*a* of the lower window sash, and a pair of aligned, flat, inner end lips 22 and 23 which are joined respectively to the side walls 20 and 21 and extend perpendicular to the latter and toward each other. These lips 22 and 23 are closely spaced from the adjacent side 12*a* of the lower window sash and they terminate short of one another to define between them a vertically elongated opening 24 leading into the track 17 at its laterally inward side (i.e., the side next to the adjacent side 12*a* of the lower window sash).

The opposite (left) side 11 of the window frame is a mirror image of the right side 12 and it presents inner and outer tracks 17 and 18 which are mirror images of those in the right side. Corresponding structural elements in the left side of the window frame are given the same reference numerals as those in the right side, and the detailed description of one side will suffice for both.

Figure 2:
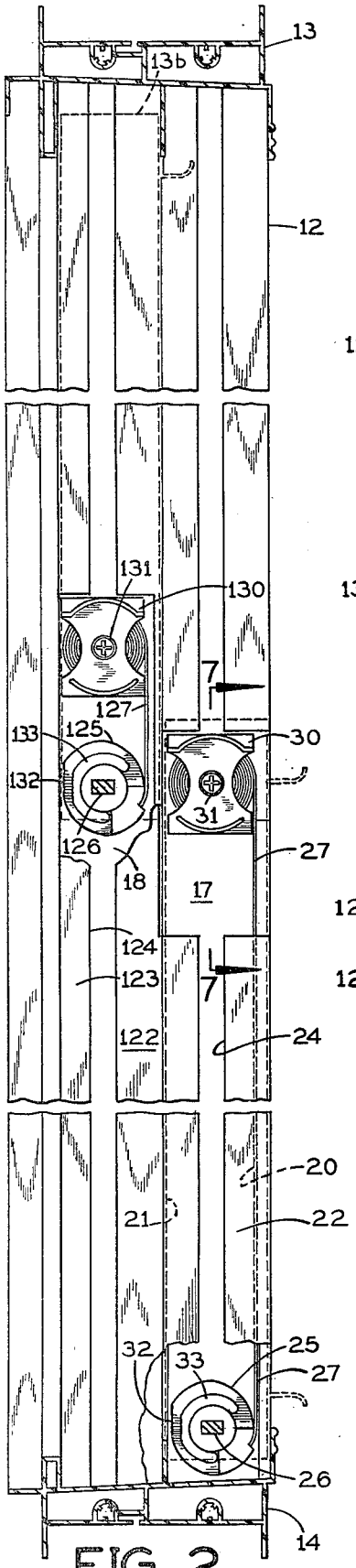
FIG. 2 is a vertical cross-section taken along the line 2—2 in FIG. 1 at one side of the window frame.

The vertically elongated inner track 17 in each side of the window frame receives a corresponding tilt-lock slide member 25 with a cam-shaped periphery, as shown in FIG. 2. This slide member is fastened to the outer end of a rectangular shank 26, which extends horizontally into the bottom piece 14*a* of the lower sash and is bolted or otherwise rigidly attached to this bottom piece. In this manner, each slide member 25 is rigidly coupled to the bottom piece 14*a* of the lower sash so that the lower sash and the two slide members 25 move up and down in unison and turn in unison in the window frame.

Figure 5:
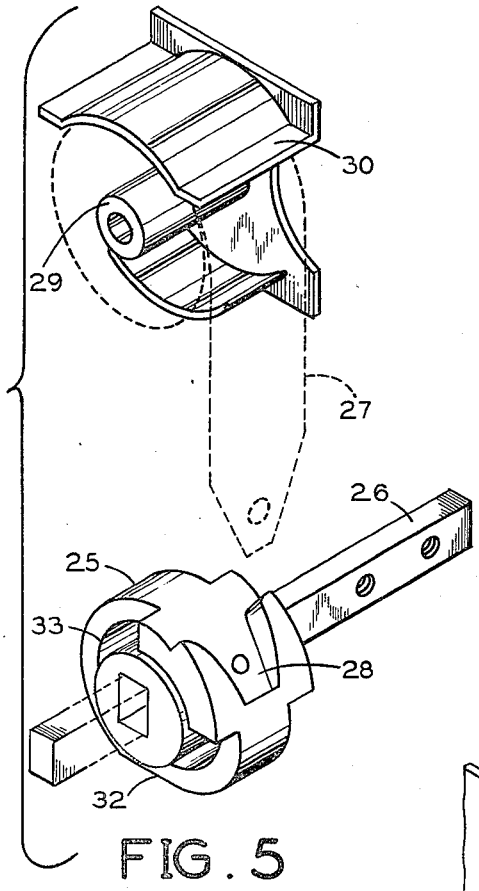
FIG. 5 is an exploded perspective view showing one of the cam-lock slides and the mounting for one of the springs acting between the window frame and one of the window sashes in FIG. 1.
Figure 6:
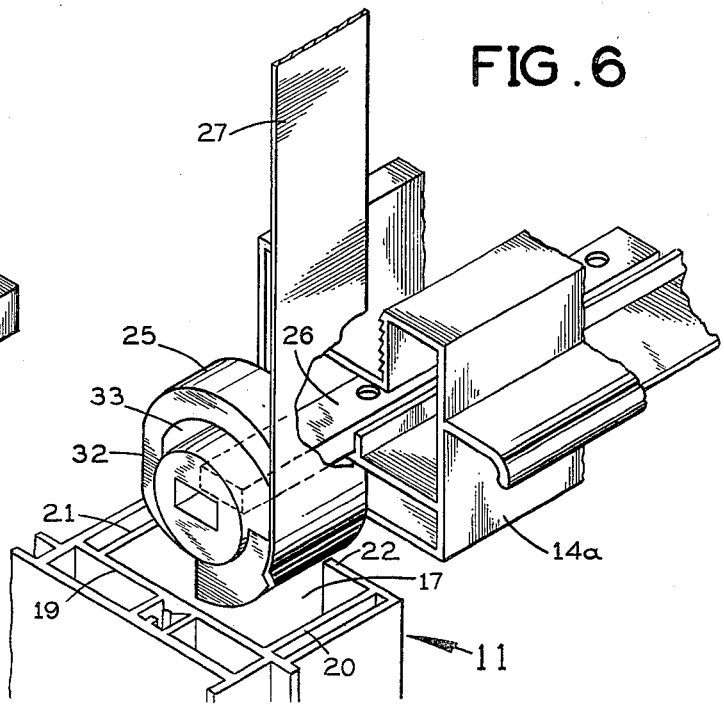
FIG. 6 is a fragmentary exploded perspective view showing one of the cam-lock slides attached to the lower end of a spring, the track in the window frame which receives this cam-lock slide and spring, and the adjacent lower corner of the window sash.
Figure 7:
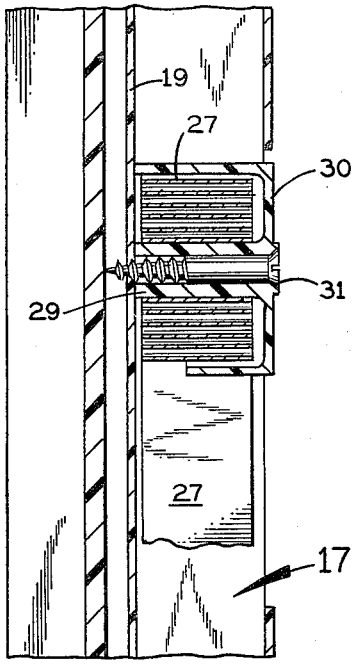
FIG. 7 is a fragmentary vertical section taken along the line 7—7 in FIG. 2 and showing the frame-mounted upper end of the spring.

A respective leaf spring 27 of thin, flat cross-section has its lower end snugly received in a recess or groove 28 formed in the periphery of the corresponding slide member 25, as best seen in FIGS. 5 and 6. The upper end of each spring is spirally wound and is fastened to the central hub 29 (FIG. 5) of a corresponding mounting bracket 30. This mounting bracket is received in the slide track 17 about half-way up that side of the window frame, as shown in FIG. 2. Referring to FIG. 7, a screw 31 extends through the hub 29 of the mounting bracket 30 and has its inner end screw-threaded into that side of the window frame. Consequently, the spring 27 has its spirally wound upper end rigidly mounted on that side of the window frame in the vertical track 17 above the slide member 25.

The unwound, vertically elongated, thin, flat length of the spring 27 extends down along the track 17 substantially contiguous to the inner side wall 20 of the window frame and completely behind the lip 22, so as to be concealed and physically shielded by the latter. The lower end of the spring 27 fits snugly in the peripheral recess 28 in the slide member 25 and is anchored to the slide member by a pin or other suitable rigid fastening arrangement.

As shown in FIG. 2, the slide member 25 has a flat segment 32 on its periphery which extends parallel to, and spaced from, the outer side wall 21 of the track 17 in the rotational position which the slide member assumes when the lower sash extends vertically upright in the window frame. In this rotational position of the slide member 25 it presents a minimum diameter extending horizontally between the opposite side walls 20 and 21 of the track and it is easily slidable up and down along the track to guide the up and down movement of the lower sash in the window frame.

Figure 9:
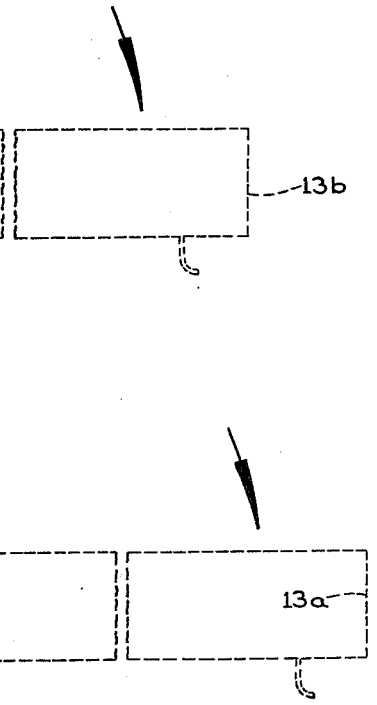
FIG. 9 is a view similar to FIG. 2 and taken along the line 9—9 in FIG. 8, showing the position of the cam-lock slides when the window sashes are tilted into the room.
Figure 3:
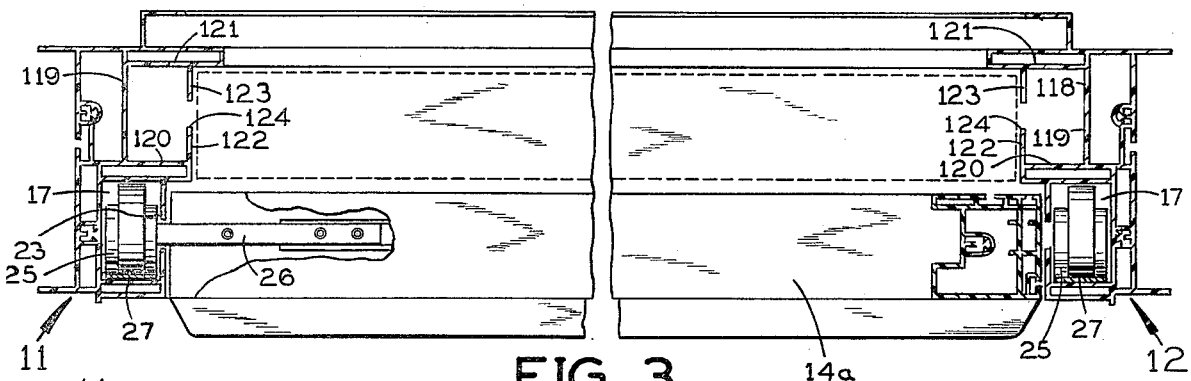
FIG. 3 is a horizontal cross-section taken along the line 3—3 in FIG. 1.

When the lower window sash is tilted into the rom (FIG. 9) this causes the slide member 25 to rotate 90 degrees from the position shown in FIG. 2 to the position shown in FIG. 9. The horizontal diameter of the slide member 25 between the opposite side walls 20 and 21 of the window frame track increases progressively as it is so turned, so that the slide member becomes wedged tightly between the opposite side walls 20 and 21 of the track 17, locking the window sash against vertical movement in the window frame when the sash is tilted in to the horizontal position shown in FIG. 9.

The slide member 25 is formed with a generally C-shaped groove 33 which is substantially concentric with its axis of rotation through the shank 26. This groove enhances the ability of the slide member to compress radially as its cam-shaped periphery is rotated into progressively tighter wedging engagement with the opposite side walls of the track 17, as described. Preferably, the slide member 25 is of resiliently deformable plastic material.

The spirally wound spring 27 exerts an upward force on the window sash to counterbalance the combined weight of the sash and window pane in any vertical position thereof within the window frame.

The novel one-piece construction of each slide member 25 and its size and shape enable it to perform two functions in the window: (1) in one rotational position, as a slide which is guided vertically along the corresponding track 17 to hold the lower window sash properly positioned in the window frame as the sash is raised and lowered; and (2) in a second rotational position, as a frictional lock which acts between the lower sash and the window frame to prevent the sash from being raised or lowered while it is tilted with respect to the window frame. As already explained, each counterbalance spring 27, because of its thin, flat cross-section, has its unwound length concealed and protected by the window frame. The lips 22 and 23 of the window frame on opposite sides of the vertically elongated opening 24 leading into the track 17 confine the slide member 25 and the spring 27 in that track.

At the outer track 18 in each side 11 and 12 of the window frame, the frame construction is essentially similar to the construction already described in detail for the inner tracks 17. The outer tracks 18 are slightly offset laterally inward from the inner tracks 17, as shown in FIG. 4. Structural elements of the window frame at the outer tracks 18 are given the same reference numerals, plus 100, as those for the inner tracks 17, so that the detailed description of these elements need not be repeated.

A spirally wound, thin, flat spring 127 acts between the window frame and a slide member 125 in each outer track 18 in the same manner as the corresponding elements 27 and 25 in each inner track 17 of the window frame. A mounting bracket 130 holds the spirally wound upper end of each spring 127 and is fastened by a corresponding screw 131 to that side of the window frame at the respective outer track 18. the lower end of each spring 127 is affixed to a corresponding slide member 125, which has a cam-shaped periphery as already described in detail for the slide members 25 in the inner tracks 17.

The tilt-lock member 125 and springs 127 are essentially the same as the slide members 25 and springs 27 for the lower sash, and therefore they need not be described in detail.

As long as the upper sash is vertically positioned in the window frame, the slide members 125 are freely slidable up and down along the respective outer tracks 18 to guide the upper sash when it is raised or lowered. When the upper sash is tilted horizontally into the room (FIGS. 8 and 9), the slide members 125 become wedged tightly into frictional engagement with the opposite side walls 120 and 121 of the respective tracks 18, thereby locking the upper sash against movement vertically along the window frame while this sash is tilted in, as shown.

Figure 10:
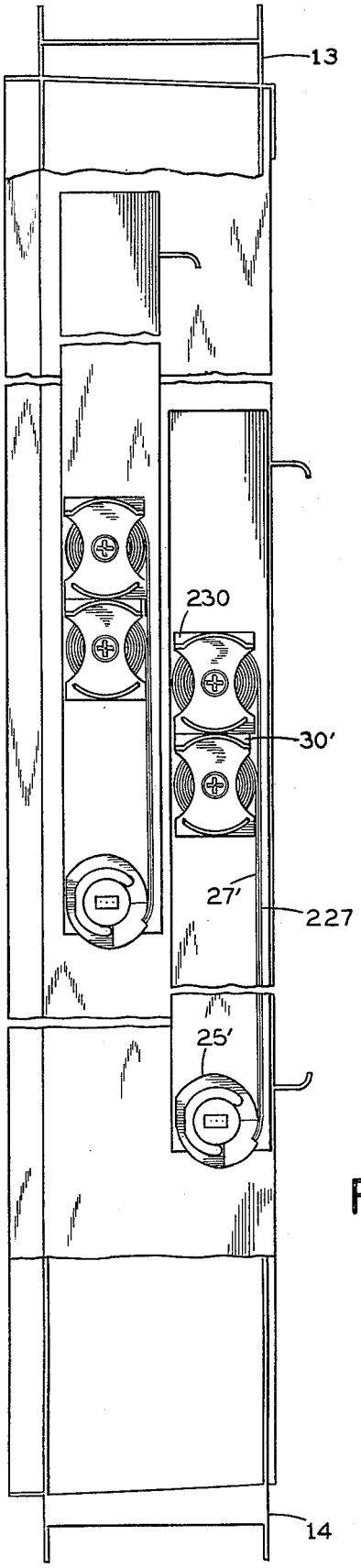
FIG. 10 is a view generally similar to FIG. 2 and showing a second embodiment of the invention in which two springs are provided for each cam-lock slide.

FIG. 10 shows a second embodiment of the present invention which has two spirally wound, flat springs at each side of each window sash. This second embodiment is advantageous for heavier windows.

The window frame has a vertically elongated inner track in each side at the inside (i.e., toward the window sash) which slidably receives a slide member 25' having a cam-shaped periphery. The construction of the window frame at this track is substantially identical to what has already been described in detail. The slide member 25' is rigidly attached to the lower end of a flat leaf spring 27', whose upper end is spirally wound in a bracket 30' attached to this side of the window frame.

A similar second bracket 230 is fastened to the window frame directly above bracket 30' and it holds the spirally wound upper end of a second flat spring 227. This unwound length of the second spring 227 extends down contiguous to the first spring 27' at the side of the latter toward the room.

Both springs 27' and 227 are concealed and protected in the track and because of their flat configuration neither interferes with the other.

More than two such springs may be provided for each slide member 25', depending upon the weight of the window sash and window pane which is to be counterbalanced by the springs.

The outer sash in FIG. 10 also is provided with two similar springs for the cam-shaped slide member at each side of the window. The arrangement here is substantially the same as the one already described for the lower sash, and it has the same advantages.

If desired, more than two counterbalance springs may be provided at each side of each window sash. The vertically offset spirally wound upper ends of the springs and their thin, flat unwound lengths down along the slide track in the window frame do not interfere with each other when the springs are arranged in multiples of two or more.

From the foregoing, it will be apparent that the present invention constitutes a novel and simplified arrangement of a tilt-lock slide and a counterbalance spring for a window sash in which the slide is of one-piece construction, serving both the function of a slide when the sash is vertical in the window frame and the function of a lock to prevent up or down movement of the sash when it is tilted. The counterbalance spring is concealed and protected by the window frame, and it is inherently adapted to be arranged in groups of two or more without interference between the springs in a group.

I claim:

1. In combination with a window frame presenting opposite vertical sides which define respective vertically elongated tracks with vertically elongated openings which face toward each other at the inside of the window frame, each of said opposite vertical sides of the window frame having opposite lateral side walls along the respective track which extend laterally outward from the respective vertically elongated opening at the inside of the window frame, and wherein said window frame at each side presents a pair of vertically elongated lips along the front and back of said vertically elongated opening at the inside of the frame, with the lips of each pair extending toward each other substantially perpendicularly away from said opposite side walls of the respective track in the window frame to confine said slide member and said spring in the respective track, and a transverse side wall at the outside of the frame extending perpendicularly between said opposite lateral side walls;

and a window sash fitting closely and slidably inside said frame;

the improvement which comprises:

a respective flat leaf spring with a spirally wound upper end fastened to said window frame and disposed in each of said tracks with the axis of said spirally wound upper end parallel to said lateral side walls, each said spring being extensible downward along the respective track substantially contiguous to and parallel to one of said lateral side walls thereof and having a width extending across said last-mentioned lateral side wall which is substantially greater than its thickness front-to-back of the window frame;

and a respective one-piece resilient slide member with a cam-shaped periphery fastened to the lower end of each spring and disposed in the respective track in the window frame, each said slide member being rigidly coupled to the window sash for movement in unison therewith vertically along the window frame and pivotally with respect to the window frame, each said slide member having a minimum diameter extending substantially horizontally when the window sash is vertical and being readily slidable vertically along the respective window frame track when its minimum diameter is substantially horizontal, and each slide member having a portion of larger diameter which is frictionally wedged between said opposite lateral side walls of the respective window frame track when the slide is turned by tilting the window sash substantially from its vertical position, whereby to lock the window sash against vertical movement in the window frame when so tilted;

said slide member having an axis substantially parallel to said lateral side walls and having means forming a substantially C-shaped opening therein extending about said axis which makes said slide member resiliently yieldable from both lateral side walls when wedged between said opposite lateral side walls to assist in said locking action;

and the lower end of said spring being partially wrapped around said periphery of said slide member when said slide member is turned.

2. The combination of claim 1 in which:

said slide member has a flat surface on its periphery reducing its diameter at said minimum diameter and a spiralling cam surface for the remainder of its periphery.

* * * * *